United States Patent [19]

Pratt et al.

[11] 3,984,214

[45] Oct. 5, 1976

[54] METAL-COATED DIAMOND ABRASIVE ARTICLE CONTAINING METAL FILLERS

[75] Inventors: Willard R. Pratt, Rochester; John H. Hawkes, Wyoming, both of N.Y.

[73] Assignee: Federal-Mogul Corporation, Detroit, Mich.

[22] Filed: Apr. 23, 1975

[21] Appl. No.: 570,682

Related U.S. Application Data

[63] Continuation-in-part of Ser. No. 337,876, March 5, 1973, abandoned.

[52] U.S. Cl. ..... 51/298 R; 51/295

[51] Int. Cl.[2] ..... C09K 3/14

[58] Field of Search ..... 51/295, 298

[56] References Cited

UNITED STATES PATENTS

| | | | |
|---|---|---|---|
| 2,243,105 | 5/1941 | Kuzmick | 51/298 |
| 3,518,068 | 6/1970 | Gillis | 51/298 |
| 3,664,819 | 5/1972 | Sioui | 51/298 |
| 3,770,400 | 11/1973 | Hallewell | 51/295 |
| 3,850,590 | 11/1974 | Chalkley et al. | 51/298 |

*Primary Examiner*—Donald J. Arnold
*Attorney, Agent, or Firm*—Robert F. Hess

[57] ABSTRACT

A diamond abrasive article preferably in the form of a grinding wheel, the work-contacting portion of which has a resinoid body containing metal coated diamond particles and also containing powdered metal of two kinds, one of the powdered metals having a relatively low melting point and the other having a substantially higher melting point, such as tin and copper, respectively.

5 Claims, 2 Drawing Figures

METAL-COATED DIAMOND ABRASIVE ARTICLE CONTAINING METAL FILLERS

CROSS-REFERENCE TO RELATED APPLICATION

This application is a continuation-in-part of application Ser. No. 337,876, filed in the UNITED STATES PATENT OFFICE Mar. 5, 1973 and now abandoned.

BACKGROUND OF THE INVENTION

The invention relates to a diamond abrasive article, such as a wheel but not necessarily of this shape, in which the diamond particles are held in a resinoid body or matrix. Many forms of such articles are known in the art.

It is also known to have the matrix include one or more powdered metals, in addition to the diamond abrasive powder or particles. Examples of such constructions are those disclosed in United States patents of Kuzmick, 2,243,105 (1941); Thompson, 3,283,448 (1966); and Gerry, 3,547,609 (1970); and in British patent 548,536 (1942) of Smit.

SUMMARY OF THE INVENTION

The present invention comprises an abrasive article (such as a wheel) the abrasive portion of which has a resinoid binder or matrix containing diamond particles or powder as the abrasive ingredient. According to the invention, the diamond particles are metallic coated, and the matrix contains, in addition to the metallic coated diamond particles, a relatively large quantity of two kinds of powdered metal, one being metal having a relatively high melting point, at least one of these being of a kind which is capable of "wetting" the metal coating on the diamond particles. This combination of two different metal powders, of high and low melting point, respectively. together with the metal coated diamonds, is found in practice to give an unexpectedly and surprisingly tenacious bond between the diamond particles and the matrix in which they are held.

DESCRIPTION OF THE PREFERRED EMBODIMENT

Figure 1:
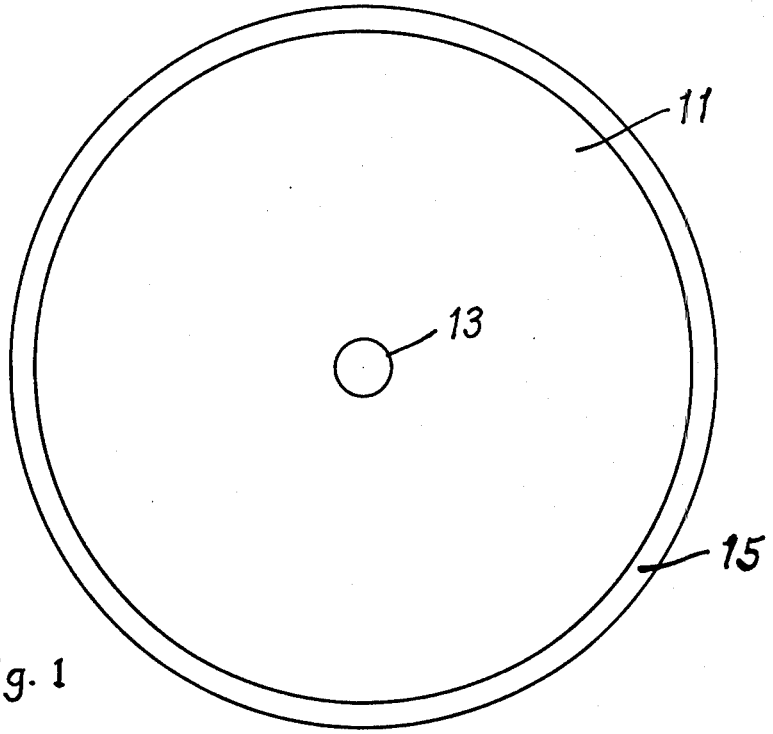
FIG. 1 is a face view of a grinding wheel in accordance with a preferred embodiment of the invention.
Figure 2:
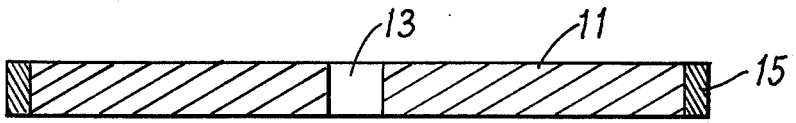
FIG. 2 is a diametrical cross-section through the same.

The present invention is preferably embodied in a grinding wheel having a disk-like core 11 provided with the usual arbor hole 13 for mounting the wheel on a rotating shaft, and an abrasive rim 15 around the periphery of the central core or disk 11. It is to the composition or ingredients of the abrasive portion 15 that the present invention particularly relates. Such composition is not necessarily used in the form of a rim on a grinding wheel, however, and it is equally within the scope of the invention to use the novel composition of the present invention in other shapes or locations instead of on the rim of a central disk. For example, the abrasive composition of the present invention may be formed into rectangular blocks to be held in the hand, or formed into rotary grinding wheels or tools of other shapes. Therefore the wheel shown in FIGS. 1 and 2 should be regarded as merely an example of a preferred form of the invention, not the only possible form thereof.

The core 11 may be conventional. The novel feature of the invention is the composition used for the rim 15, or for any other abrasive article for which such composition may be employed. As already indicated briefly above, the composition is composed essentially of a mixture of phenolic resin, metallic powder of two different kinds of metal, one with a relatively low melting point and one with a relatively high melting point, and abrasive grain in the form of diamond dust or particles with the individual diamond elements having a metallic coating.

Abrasive mixtures have previously been made, containing powders of high melting point and low melting point metals, and diamond particles (but not metallic coated diamonds), bound in a resinoid binder, as shown for example in the above mentioned U.S. Pat. No. 2,243,105 and British Pat. No. 548,536. It is also known from U.S. Pat. No. 3,650,714 to use metal coated diamond particles in manufacturing abrasive articles, but not in combination with a resinoid binder containing powders of high melting point and low melting point metals. The present invention is based upon the discovery of the surprising and unexpected beneficial results obtained by using metal coated diamond particles, plus a metal powder of relatively high melting point, and metal powder of relatively low melting point, all bound together with a phenolic or resinoid binder, the beneficial results being obtained especially when at least one of the metallic powders is a powder of a metal which will "wet" the metal with which the diamond particles are coated.

The low melting point metal powder in the matrix mixture should be one having a melting point below 660° Centigrade, and preferably below 250° Centigrade. The following metals are suitable for purposes of the present invention, their approximate melting points in degrees Centigrade being as here indicated: aluminum, 659 degrees; magnesium, 651°; antimony, 630°; zinc, 419°; lead, 327°; cadmium, 321°, bismuth, 271°; tin, 232°, and indium, 156°. Of these, tin is preferred. Also, alloys having melting points within this range may be used, instead of pure metals.

The metal of higher melting point is preferably one having a melting point higher than 950 degrees Centigrade. Among the metals suitable for purposes of the present invention are the following, their approximate melting points being here given: silver, 961°; copper, 1083°; nickel, 1455°; cobalt, 1495°; iron, 1535°; chromium, 1890°; and tungsten, 3370°. Alloys having melting points within this range may also be used. The choice of which metal (or alloy) to use will depend partly on whether the metal (or alloy) will be readily "wet" by the lower melting point metal or alloy. The metallic coating on the diamond particles should also be wetted by the lower melting point metal or alloy. Consequently the choice of the low melting point metal powder or alloy depends partly on what metal is used to coat the diamond particles. Although several metals are available for coating the diamond particles, they are usually coated with either copper or nickel. A copper coating on the diamond particles is preferred, and if this is used, then copper is also the preferred material for the high melting point powder ingredient of the matrix, since any metal or alloy which will wet the copper coating on the diamonds will also wet the copper used as the high melting point ingredient. Similarly, if the diamond particles are coated with nickel, then nickel would be a good material to use for the higher melting point powder component of the matrix.

The metallic coating may be applied to the diamond particles by known techniques. For example, the previously mentioned U.S. Pat. No. 3,650,714 discloses methods of coating diamond particles with various metals, including coatings of copper, nickel, or iron. However, other techniques for applying metallic coatings to the diamond particles are known, and may be used. In addition, metallic coated diamond particles are available on the open market. For example, General Electric Company furnishes diamonds coated with copper under the designation "RVG-D" and diamonds coated with nickel under the designation "RVG-W."

The thickness of the metallic coating on the diamond particles may vary considerably. Excellent results have been obtained, for purposes of the present invention, by using copper coated diamonds in which the diamond weight is about 50% and the coating weight about 50% of the total weight of the diamond particle plus coating. For nickel coated diamond particles, it is preferred to use a coating of such thickness that the diamond weight is about 45% and the coating weight about 55% of the total weight of the coated diamonds.

Diamonds may also be coated with nickel in this way. A quantity of diamond particles or powder is carefully cleaned by boiling in sulfuric acid to which a solution of potassium dichromate has been added. After removal from this cleaning bath, the diamonds are washed with distilled water, and then placed in a bath composed of 15 grams of nickel sulphate, 14 grams of sodium hypophosphite, and 13 grams of sodium acetate, dissolved in 1000 cubic Centimeters of distilled water, this bath being maintained at a temperature from about 87° C. to 99° C. in a pyrex beaker. The diamonds in the bath are stirred periodically. When a sufficient coating of nickel is deposited on the diamonds, they are removed from the bath, washed, and dried.

Similar baths have been developed and are known in the art, for applying a copper coating rather than a nickel coating to the diamond particles.

It is usually preferred, however, to obtain the diamonds already coated, from a supplier of such articles. The coated diamonds may be used according to the following general example:

A matrix is prepared using 40% to 45% by weight high melting point metallic powder, 40% to 45% by weight low melting point metallic powder, and the remainder being a phenolic resinoid bonding material to make up 100% of the aggregate. To this matrix, there is blended and uniformly distributed diamond powder that has been precoated with high melting point metal selected from the group stated above, and preferably the same as the high melting point metallic powder of the matrix. The coated diamond powder may be used in a quantity ranging from 5% to 55% by weight of the quantity of the matrix being used. The smaller concentration of coated diamond powder would be used for light lapidary work for example. Our preferred range for the heavy duty work is 40% to 45%. This mix is then molded around the rim of a previously prepared partially cured core or disk. The curing process is then completed by increasing the temperature and pressure to predetermined levels for a specific length of time depending on the phenolic molding compound being used.

A specific example for making an abrasive article according to the present invention is to prepare a bond mix made up of copper powder, tin powder and phenolic resinoid binding material in the proportions of 8.41 grams of copper powder (43.5% by weight), 8.41 grams of tin powder (43.5%), and 2.63 grams of phenolic resinoid bonding material (13.5%). The copper powder was secured from Alcan Metal Powders, designated by them as M. D. 301. The tin powder was also secured from Alcan Metal Powders. The phenolic bonding material was secured from Union Carbide Corporation, designated by them as "BAKELITE" phenolic bonding material no. BRP-5980.

To this bond mix, having a weight of 19.45 grams, there was added 8.12 grams of copper coated diamond powder, secured from General Electric Company and designated by them as RVG-D copper coated diamond powder. The diamonds were disbursed approximately uniformly through the bond mix. The mix with the diamonds therein was then molded around the rim of a previously partially cured core or disk of an aluminum bearing phenolic molding compound, secured from Plastics Engineering Company and designated by them as "Plenco" 201 molding compound. The molding was accomplished substantially as described in Sanford patent 2,073,590, using a molding temperature of approximately 177°C., for one-half hour at a pressure of about 2 tons per square inch. The work was then stripped from the mold, and further cured by heating it to about 177°C. in an oven, for 4 hours, to complete the cure of the resin binder. The finished wheel was a 6 inch diameter wheel, one-sixteenth of an inch thick, of the shape shown in FIGS. 1 and 2 of the present drawings, this being the shape designated as 1A1 in USA specification B 74.3-1966, USA standard specifications for shapes and sizes of diamond grinding wheels.

After completion of curing, the grinding wheels was lapped, the sides were ground true, the arbor hole was machined to size, and the face was ground true. The wheel was then put into operation on hand grinding the flutes on cemented tungsten carbide cutters.

It was observed that the cutting operation was exceptionally good and the work being ground remained cooler than when grinding was competitive wheels which contained only high melting point metallic fillers. The exact scientific reasons why this wheel gives superior results are not fully understood. It is believed, however, that the use of the low melting point metallic powder in combination with the high melting point metallic powder provides material which will melt and become fluid under the influence of the heat generated during high pressure contact between the grinding wheel and the work, the fluid metal from the melted powder serving both as a lubricant for movement of the wheel relative to the work, and as a heat conductor for conveying heat away from the contact point. This possible explanation of the operation seems to be confirmed by the observation that a fine material was cast out of the grinding wheel over a period of time, and collected on the magnifying glass used as a view piece for observing the work. An examination of this material indicated that it was a fine film of stannous oxide.

As the testing of this wheel progressed, it became apparent that several things were taking place in the wheel matrix. Because the work is held by hand and no work rest is provided, it is difficult to use consistently the same pressure of the work against the wheel. As a result, the wheel is loaded heavily from time to time during the cutting operation, and serious wheel wear takes place during such times of heavy loading or heavy pressure of the work against the wheel. A substantial amount of heat is developed at these times of overloading, and unless something is done to lessen this heating problem, the grinding wheel will burn and glaze, causing excessive wheel wear and injuring the work.

It had become a common practice in the industry to use diamond abrasive wheels with relatively low resin content and large amounts of metal powders such as copper powder to act as a heat sink to help this problem of overheating. In the diamond wheel of the present invention, formulated as described above, several factors appeared to be present, to produce improved results. First and most important is that because of the combination of the tin powder along with the copper powder and the copper coated diamond particles, as soon as overheating occurred the fine particles of tin in the matrix melted and wet both the metallic coating on the diamond particles or grain, and the skeleton of copper metal powder in the organic resin mass. This alloyed the coated diamond grain and the skeleton of higher melting copper powder together at once, enhancing the strength of holding the diamond particles in place and compensating for any loss of strength caused by degradation of the organic phenolic resin bond. Simultaneously, a small amount of fine tin was melted and cast out of the wheel, cooling it by the latent heat of fusion of the tin. The net effect was a cool and free cutting wheel which is long lasting and free of any tendency to burn or otherwise injure the work being operated upon.

Therefore, it appears to be important to use, as the low melting point metallic powder, a metal which, when melted or fluid, will "wet" both the metallic coating on the diamond particles and also the high melting point metallic powder, so that the lower melting point which is melted or becomes fluid during intermittent intervals of high pressure contact with the work will produce an alloy with the metallic coating on the diamond and the high melting point metallic filler, which will hold the diamond particles more firmly in place during the intermittent intervals when less pressure is applied between the grinding wheel and the work, and less heat is generated, and the lower melting point metallic ingredient may solidify from its temporarily fluid form.

A grinding wheel of this type is intended primarily for dry cutting, but it will also cut well with applied coolant because of the basic resin bond holding it together.

Is is not necessary to use pure metals either for the low melting point powder or the high melting point powder. Either or both of the powders can be formed of alloys. Also, in either category (low melting point or high melting point) more than one kind of metal may be used. For example, the low melting point metallic filler can be a mixture of powders of any two or more of the metals above mentioned as suitable in this category, such as a mixture of tin powder and zinc powder, or a mixture of bismuth powder and lead powder, or a mixture of all four of the powders just mentioned. Similarly, the high melting point ingredient can be a mixture of any two or more of the powders of the metals above mentioned as suitable for the high melting point ingredient, such as a mixture of copper powder and nickel powder, or a mixture of silver powder and cobalt powder, and so forth.

It should be mentioned that the diamond particles may be synthetic or artificial, as well as natural diamonds.

The description of the invention provided herein is illustrative rather than limiting, and the scope of this invention is limited only by the scope of the appended claims.

We claim:

1. An abrasive article having a work-engaging portion comprising diamond particles each having a metallic coating composed essentially of metal of relatively high melting point, embedded in a substantially nonporous matrix comprising a resinoid binder, a quantity of powdered metal of relatively low melting point, and a quantity of powdered metal of relatively high melting point, the coated diamond powder being present in the work-engaging portion in a quantity ranging from 5% to 55% by weight of the quantity of matrix, said metal of relatively high melting point of said metallic coating and said metal of relatively high melting point of said resinoid binder being chosen from one or more metals or their alloys selected from the group consisting of silver, copper, nickel, cobalt, iron, chromium, and tungsten, said metal of relatively low melting point being chosen from one or more metals of their respective alloys selected from the group consisting of zinc, lead, cadmium, bismuth, tin and indium, said metallic coating being present in an amount by weight at least substantially equal to the weight of said diamond particles, said low melting point metal and said high melting point metal of said matrix being present in substantially equal amounts by weight and collectively equaling 80% to 90% by weight of the matrix, and the remainder being the resinoid binder, whereby, the low melting point metal is present by relative weight and in such form in relation to other ingredients that under heat caused by heavy grinding pressure part of the low melting point metal will melt and alloy the metallic coating on the diamond particles with the high melting point metal of the matrix.

2. The article is defined in claim 1 wherein, the diamond particles including said metallic coating being present in an amount equaling by weight approximately 40 to 45 percent of the weight of said matrix.

3. An abrasive article as defined in claim 1 wherein, said metal of relatively low melting point is tin and said metal of relatively high melting point in said metallic coating and said matrix is copper.

4. An abrasive article as defined in claim 3 wherein, said tin and said copper are present in essentially equal amounts by weight and collectively make up approximately 87% by weight of the matrix.

5. An abrasive article as defined in claim 4 wherein, the diamond particles including said metallic coating are present in an amount equaling approximately 42% by weight of said matrix.

* * * * *